US005151734A

United States Patent [19]

Tsuda et al.

[11] Patent Number: 5,151,734

[45] Date of Patent: Sep. 29, 1992

[54] PROCESS CARTRIDGE DETACHABLY MOUNTABLE TO IMAGE FORMING APPARATUS FEATURING A PERIPHERALLY SUPPORTED IMAGE BEARING DRUM

[75] Inventors: Tadayuki Tsuda, Kawasaki; Kazushi Watanabe, Yokohama; Isao Ikemoto, Kawasaki; Shinichi Sasaki, Fujisawa, all of Japan

[73] Assignee: Canon Kabushiki Kaisha, Tokyo, Japan

[21] Appl. No.: 580,563

[22] Filed: Sep. 11, 1990

[30] Foreign Application Priority Data

Sep. 16, 1989 [JP] Japan ..... 1-238382

[51] Int. Cl.[5] ..... G03G 15/00

[52] U.S. Cl. ..... 355/200; 355/210; 355/211

[58] Field of Search ..... 355/200, 210, 211, 260, 355/245; 384/295, 296, 299, 300

[56] References Cited

U.S. PATENT DOCUMENTS

| | | | |
|---|---|---|---|
| 3,966,316 | 6/1976 | Pfeifer et al. | 355/200 |
| 4,134,667 | 1/1979 | Schnall et al. | 355/211 |
| 4,386,838 | 6/1983 | Hirabayashi et al. | 355/200 |
| 4,470,689 | 9/1984 | Nomura et al. | 355/211 |
| 4,575,221 | 3/1986 | Onodo et al. | 355/200 |
| 4,591,258 | 5/1986 | Nishino et al. | 355/200 |
| 4,627,701 | 12/1986 | Onoda et al. | 355/221 |
| 4,639,119 | 1/1987 | Isaka | 355/260 X |
| 4,685,792 | 8/1987 | Iseki et al. | 355/309 |
| 4,708,455 | 11/1987 | Kubota et al. | 355/260 X |
| 4,829,335 | 5/1989 | Kanemitsu et al. | 355/211 |
| 4,873,940 | 10/1989 | Ishikawa et al. | 118/651 |
| 4,965,633 | 10/1990 | Surti | 355/200 |
| 4,972,227 | 11/1990 | Onoda et al. | 355/210 |
| 4,975,744 | 12/1990 | Ebata et al. | 355/211 |

FOREIGN PATENT DOCUMENTS

| | | |
|---|---|---|
| 0092689 | 11/1983 | European Pat. Off. . |
| 0144056 | 6/1985 | European Pat. Off. . |
| 0433061 | 6/1991 | European Pat. Off. . |
| 2347713 | 4/1977 | France . |

OTHER PUBLICATIONS

European Search Report.
Annex to European Search Report.
French Search Report.

*Primary Examiner*—A. T. Grimley
*Assistant Examiner*—William J. Royer
*Attorney, Agent, or Firm*—Fitzpatrick, Cella, Harper & Scinto

[57] ABSTRACT

A process cartridge detachably mountable to an image forming apparatus includes an image bearing drum; process device actable on the image bearing drum; a housing for accommodating the image bearing drum and the process device; and supporting means for rotatably supporting the image bearing drum at an outer periphery of the image bearing drum.

24 Claims, 3 Drawing Sheets

PROCESS CARTRIDGE DETACHABLY MOUNTABLE TO IMAGE FORMING APPARATUS FEATURING A PERIPHERALLY SUPPORTED IMAGE BEARING DRUM

FIELD OF THE INVENTION AND RELATED ART

The present invention relates to a process cartridge detachably mountable to an image forming apparatus such as an electrophotographic copying machine, an electrophotographic printer or an electrostatic recording apparatus, more particularly to a process cartridge containing an image bearing drum and at least one process means actable on the image bearing drum.

In a conventional image forming apparatus such as a copying machine, a printer or facsimile machine, plural consumable parts contributable to image formation are constituted as a unit, and the unit as a whole is exchanged to make the maintenance operation easier.

As for such an image forming unit, a process cartridge is known as disclosed in U.S. Pat. No. 4,470,689, for example, wherein a housing contain a photosensitive member, and at least one process means such as a charger, developing device or cleaning device, for example, and the process cartridge as a whole is detachably mountable to the main assembly of the image forming apparatus.

Referring first to FIG. 6, the image bearing drum is supported in the manner shown in this Figure. FIG. 6 is a sectional view illustrating the supporting structure for the photosensitive drum 103 which is the image bearing member. The photosensitive drum 103 comprises a hollow drum 124 and flanges 125 and 126 press-fitted into, bonded to or clamped into, the insides of the hollow drum 124 at its opposite ends. The photosensitive drum is rotatably supported in the housing 102 by centering shafts 127 and 128 penetrating through the flanges 125 and 126, respectively. A developing roller or sleeve 107 of the developing device is rotatably supported in a developer container 104 through flanges 129 and 130 which also function as centering shafts.

In the conventional supporting structure, the surface of the photosensitive drum 103 and the surface of the developing sleeve 107 whirls, when it is rotated, by the amounts of the eccentricity errors of the inside and outside diameters of the flanges 125, 126, 129 and 130 relative to the rotational axes 131 and 132 plus the eccentricity errors of the inside and outside diameters of the photosensitive drum 103 or the developing sleeve 107. This makes it difficult to maintain the accurate relative positional relation between the photosensitive drum 103 and the process means disposed therearound.

Taking the cleaning blade 120 contacted to the photosensitive drum 103 for example, if the degree A of the press-contact of the edge of the cleaning blade 120 to the surface of the photosensitive drum 103 is too small, the cleaning is not sufficient due to passage of the residual toner on the surface of the photosensitive drum 103. If, on the contrary, the degree A is too large, the photosensitive layer at the surface of the photosensitive drum 103 is scraped significantly with the result of decreased durability of the photosensitive drum 103.

Particularly, when the cleaning blade 120 is fixed on the housing 102 supporting the photosensitive drum 103, the whirling of the surface of the photosensitive drum 103 directly affects the degree A of the press-contact with the cleaning blade 120, more particularly, causes periodic change. In order to assure the accuracy in the relation between the cleaning blade 120 and the photosensitive drum 103, it is required to maintain the high accuracies in the cleaning edge, the housing 102, the inside and outside diameter of the photosensitive drum 103, the flanges 125 and 126 and others. This results in cost increase, decrease in the yield and increase in the number of inspection steps.

In the developing device 104, the clearance B between the surface of the photosensitive drum 103 and the developing sleeve 107 (S-D gap) is required to be maintained with precision. If the S-D gap B is too small, the developed image has too high density as if character image is collapsed. If the gap B is too large, the character image becomes thin and light.

With the conventional supporting structure for the photosensitive drum 103 and the developing sleeve 107, the whirling of the surfaces of the photosensitive drum 103 and the developing sleeve 107 causes the periodic change of the S-D gap B during rotation, with the result that the non-uniformity in synchronism therewith appears in the developed image.

SUMMARY OF THE INVENTION

The present invention has been made in view of the foregoing problems, and has a principal object to provide a process cartridge wherein the whirling of the image bearing drum or the developing sleeve is sufficiently suppressed with a simple structure.

It is another object of the present invention to provide a process, cartridge wherein the process means is easily positioned correctly relative to the image bearing drum, and image defect such as non-uniformity can be prevented.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Figure 1:
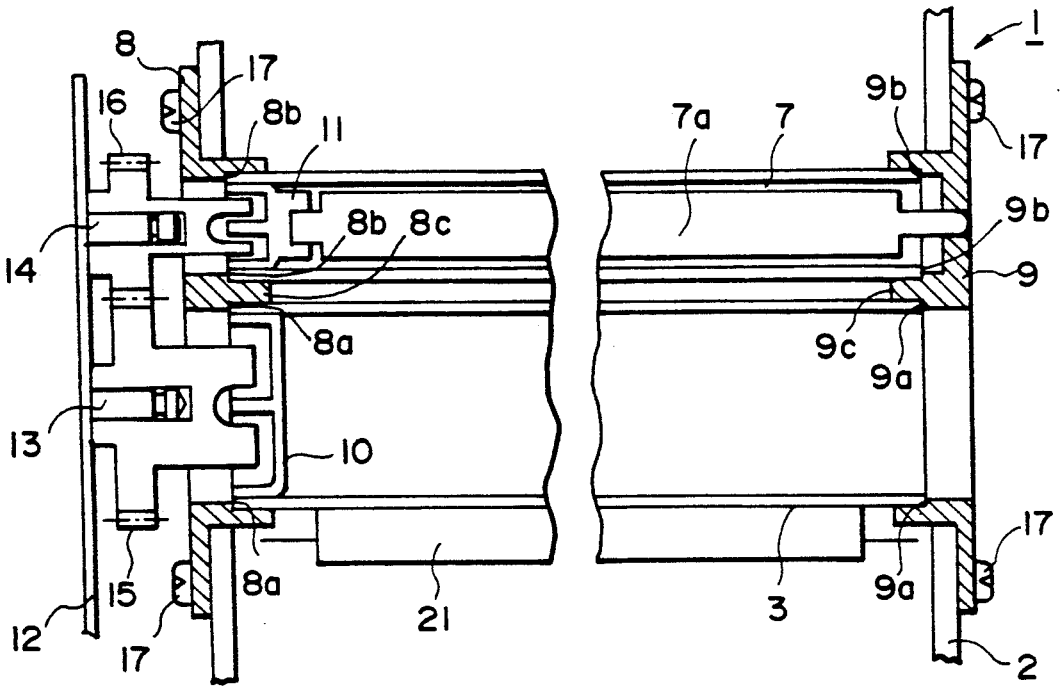
FIG. 1 is a cross-sectional view of a process cartridge according to an embodiment of the present invention (taken along a line C—C' in FIG. 2).
Figure 2:
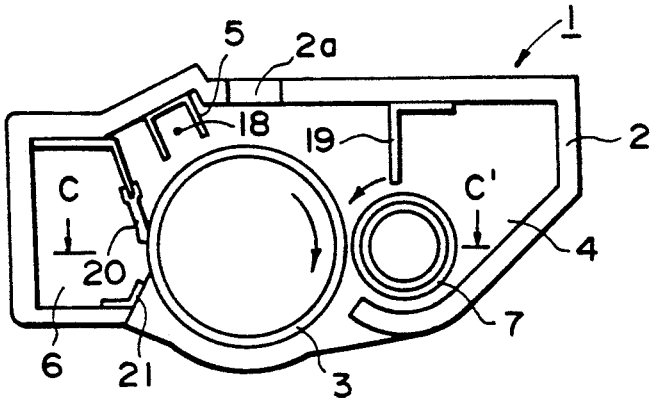
FIG. 2 is a longitudinal sectional view of the process cartridge.
Figure 3:
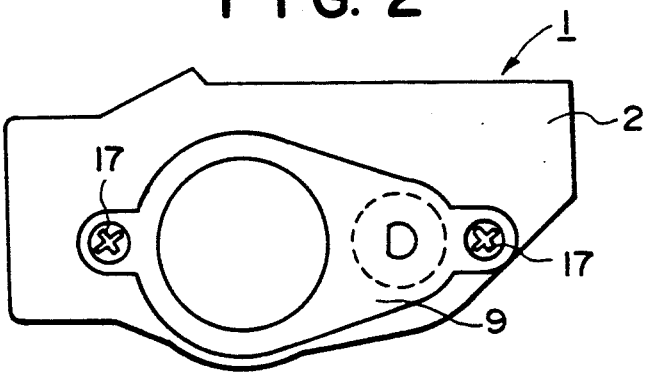
FIG. 3 is a front view of the process cartridge.

Referring to FIGS. 1, 2 and 3, there is shown a process cartridge according to an embodiment of the present invention. FIG. 1 is a sectional view taken along a line C—C' of FIG. 2.

The process cartridge 1 comprises one housing 2, a photosensitive drum (image bearing drum) 3. It also contains as process means a developing device 4, a charging device 5 and a cleaning device 6 in a compact manner. They are formed into a unit. The process cartridge is detachably mountable to a known image forming apparatus.

As shown in FIG. 1, the outer peripheries of the photosensitive drum 3 and the developing sleeve 7 of the developing device 4 are rotatably supported at the opposite ends thereof by supporting members 8 and 9, respectively, fixed in the housing 2. A flange 10 or 11 is bonded to the inside, at one end, of the photosensitive drum 3 or the developing sleeve 7.

The magnet roller 7*a* in the developing sleeve 7 is supported by the supporting member 9 and the flange 11. In FIG. 2, an aperture for the image exposure is indicated by a reference 2*a*.

To the shafts 13 and 14 projected in a main assembly 12 of the image forming apparatus are rotatably mounted driving gears 15 and 16 having large and small diameters, which are in meshing engagement with each other. When the process cartridge is mounted to the main assembly, the driving gears 15 and 16 are meshed with the flanges 10 and 11, as shown FIG. 1. The photosensitive drum 3 and the developing sleeve 7 receive the driving force from the driving gears 15 and 16, respectively to rotate in the directions indicated by arrows in FIG. 2.

As shown in FIGS. 1 and 3, the bearings 8 and 9 are fixed in the housing 2 by screws 17. The bearing or supporting members 8 and 9 are provided with steps 8*a*, 8*b*, 9*a* and 9*b*. The steps 8*a* and 9*a* limit the longitudinal movement of the photosensitive drum 3, and the steps 8*b* and 9*b* limit the longitudinal movement of the developing sleeve 7.

Since the photosensitive drum 3 and the developing sleeve 7 are supported by the supporting members 8 and 9 at the outer peripherals at their opposite ends, the whirling upon rotation is limited to the whirling error of the opposite outer peripheries only, that is, only one outer periphery at each end. The photosensitive drum 3 and the developing sleeve 7 are produced by extrusion or machining, and therefore, the whirling error at the outer peripheries at the opposite ends can be limited to not more than 0.05 mm. Therefore, the rotational whirling of the photosensitive drum 3 and the developing sleeve 7 can be limited to be very small, that is, in the same order. Therefore, the non-uniformity in the image attributable to the rotational whirling can be prevented.

By supporting the outer periphery of the photosensitive drum, the whirling of the photosensitive drum surface can be reduced, and therefore, the accuracy of the edge of the cleaning blade 20 may be relatively eased, by which the cost increase of parts can be reduced, the yield can be increased, and the number of inspection steps can be reduced.

As shown in FIG. 2, a charging wire 18 of the charging device 5, the developing sleeve 7 and a development blade 19 of the developing device 4, the cleaning blade 20 and the toner receiving member 21 of the cleaning device 6, are fixed in the housing 2 supporting the supporting members 8 and 9, and therefore, the gap or the degree of press-contact with the photosensitive drum 3 are maintained constant. As a result, the image nonuniformity due to improper charging or development can be prevented; and improper cleaning for the residual toner can be prevented.

According to this embodiment, only one flange 10 or 11 may be bonded to the inside of each of the photosensitive drum 3 and the developing sleeve 7, and therefore, the number of parts and number of steps for the bonding or the press-fitting can be reduced.

In this embodiment, portions 8*c* and 9*c* of the supporting members 8 and 9 function as spacer means for maintaining a constant clearance between the surfaces of the photosensitive drum 3 and the developing sleeve 7, and therefore, the possible image non-uniformity attributable to the variation of the clearance can be prevented.

Another spacer means may be usable. The spacer means may include spacer rollers rotatably engaged to the developing sleeve and contacted to the surface of the photosensitive drum, thus maintaining a predetermined clearance between the photosensitive drum and the developing sleeve. The spacer rollers rotate following the rotational whirling of the photosensitive drum or the developing sleeve. However, when the whirling is large or when the rotational speed of the sleeve is high, the spacer rollers can be spaced apart from the photosensitive drum or from the developing sleeve, or the rotation of the spacer rollers becomes irregular, so that the wearing of the spacer roller becomes nonuniform, with the result that the clearance between the photosensitive drum and the developing sleeve is not constant. If this occurs, the nonuniformity of the image can occur. However, according to the present invention, the rotational whirling can be minimized by supporting the outer peripheries of the photosensitive drum and the developing sleeve, and therefore, it is effective to use the supporting structure and simultaneously to use the spacer rollers to assure the clearance between the photosensitive drum and the developing sleeve by the diameter of the rollers.

Figure 4:
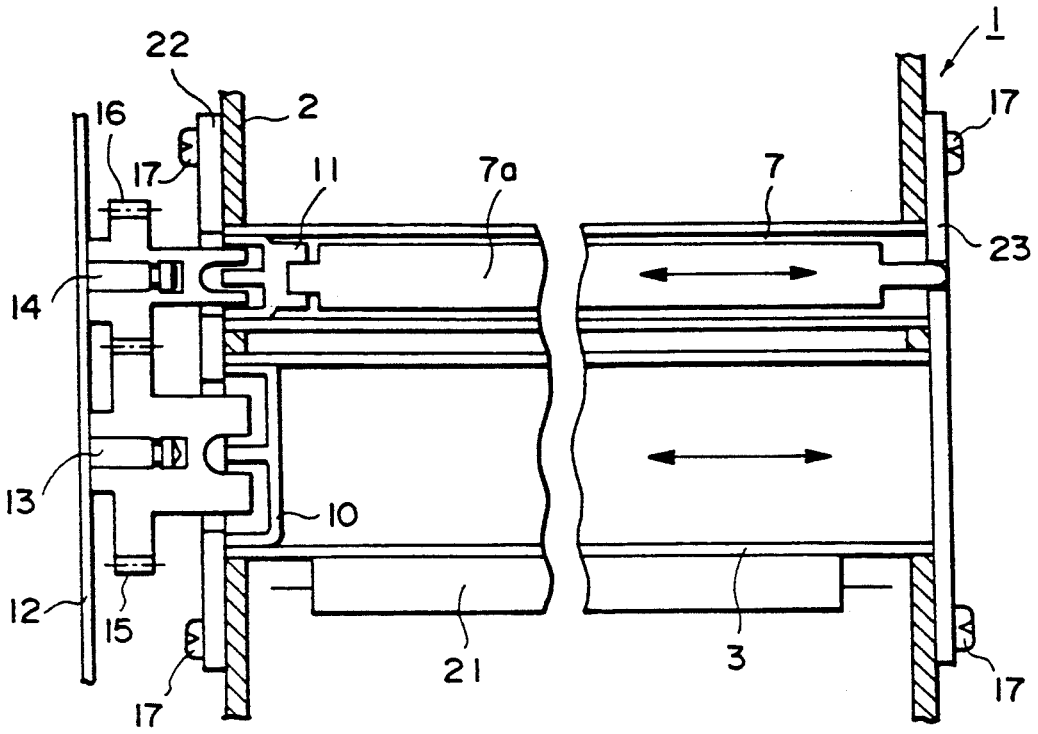
FIG. 4 is a cross-sectional view of a process cartridge according to another embodiment of the present invention.

Referring to FIG. 4, there is shown another embodiment. In this Figure, the same reference numerals as in the foregoing embodiment, particularly FIG. 1, are assigned to the elements having the corresponding functions.

In this embodiment, the supporting members 8 and 9 in the foregoing embodiment (FIG. 1) are not used, and the outer peripheries at the opposite ends of each of the photosensitive drum 3 and the developing sleeve 7 are directly supported on the housing. The photosensitive drum 3 and the developing sleeve 7 are limited in their longitudinal direction by thrust bearings 22 and 23 fixed on the housing 2. In this embodiment, the housing 2 functions as the supporting member.

This embodiment is advantageous over FIG. 1 embodiment in that the whirling of the photosensitive drum 3 and the developing sleeve 7 can be further reduced because they are supported not through the supporting members 8 and 9. The photosensitive drum 3 and the developing sleeve 7 are mounted in the housing 2 by inserting them in the direction indicated by arrows, or by utilizing the elasticity of the housing 2 and expanding it and inserting the photosensitive drum 3 and the developing sleeve 7.

Figure 5:
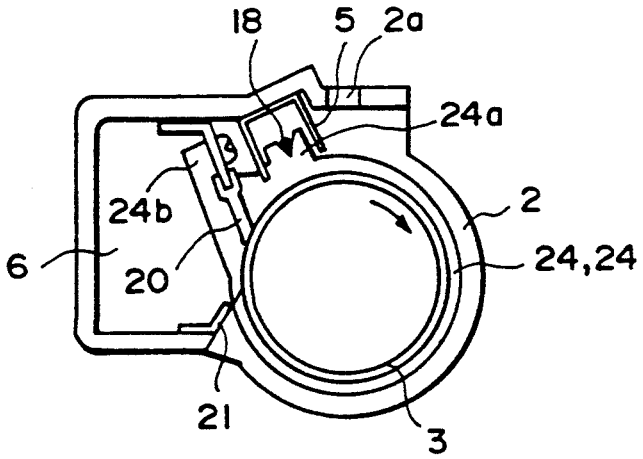
FIG. 5 is a longitudinal sectional view of a process cartridge according to a further embodiment of the present invention.
Figure 6:
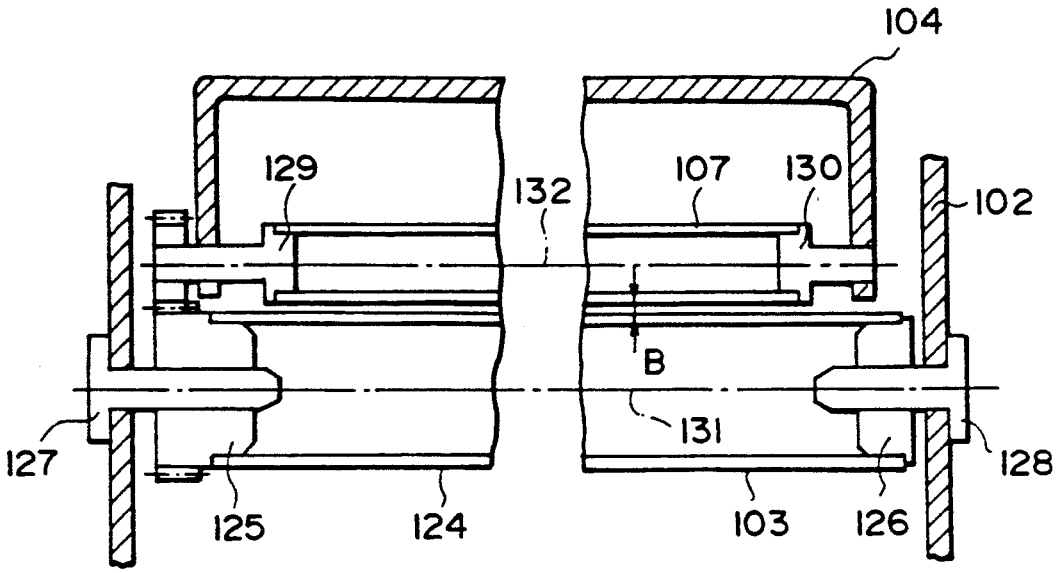
FIG. 6 (PRIOR ART)
FIG. 6 is a cross-sectional view of a conventional process cartridge.
Figure 7:
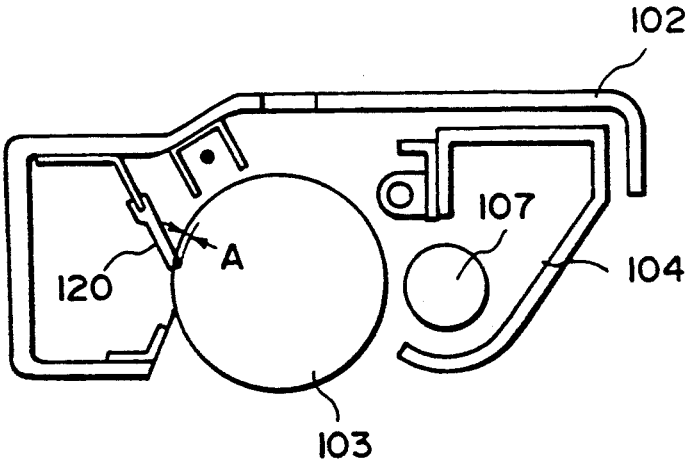
FIG. 7 (PRIOR ART)
FIG. 7 is a longitudinal sectional view of the process cartridge of FIG. 6.

FIG. 5 shows a further embodiment. In this embodiment, the process cartridge contains the photosensitive drum 3, the charger 5 and the cleaning device 6 as a unit, but does not contain the developing device.

In this embodiment, the outer peripheries of the photosensitive drum 3 at the opposite longitudinal ends are supported by supporting members 24 and 24 (only one is shown) fixed in the housing 2 of the process cartridge. The charging wire 18 of the charger 5 is received by a groove 24*a* formed in a part of the supporting member 24 to maintain a constant clearance between the charging wire 18 and the photosensitive drum 3. A part of the supporting member 24 is used as a fixing portion 24*b* for the cleaning blade 20, so that the degree of press-contact of the edge of the cleaning blade to the photosensitive drum is maintained constant.

In this manner, the members such as the charging wire or the cleaning blade, actable on the photosensitive drum are supported by the supporting member for supporting the outer periphery of the photosensitive drum, so that the members can be correctly positioned relative to the photosensitive drum with precision.

In the foregoing embodiments, the outer peripheral portions at the opposite ends where the photosensitive drum is supported by the supporting members, are non-image-forming portions of the photosensitive drum, more particularly, end portions of a cylinder which is a base member of the photosensitive drum, in this embodiment.

Similarly, the outer peripheries at the opposite ends of the developing sleeve where the supporting members support it does not carry the developer.

As described in the foregoing, by supporting the image bearing drum at its outer periphery, the whirling upon rotation can be reduced as compared with the conventional supporting structure. In addition, by supporting the process means by the supporting members supporting the image bearing drum, the positional accuracy of the process means relative to the image bearing drum can be improved. Therefore, good images without the defects such as non-uniformity can be stably provided.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to an image forming apparatus, comprising:
- an image bearing member;
- process means actable on said image bearing member;
- a frame for supporting said process means; and
- supporting means mounted on said frame for rotatably supporting an outer periphery of said image bearing member.

2. A cartridge according to claim 1, wherein said frame functions as said supporting means.

3. A cartridge according to claim 2, wherein said process means includes charging means, developing means and cleaning means.

4. A cartridge according to claim 1, wherein said process means comprises charging means, developing means and cleaning means.

5. A cartridge according to claim 1, wherein said supporting means has a portion functioning as a spacer.

6. A cartridge according to claim 1, wherein said frame further comprises a second supporting means for rotatably supporting the outer periphery of said process means.

7. A cartridge according to claim 6, wherein said frame functions as said second supporting means.

8. A cartridge according to claim 1, wherein said supporting means supports a non-image forming portion of said image bearing member.

9. A cartridge according to claim 1, wherein said supporting means supports said image bearing member at its longitudinal end portions.

10. A cartridge according to claim 1, wherein said frame functions as said supporting means, and an outer periphery of said image bearing member is directly supported by said frame.

11. A cartridge according to claim 1, wherein said supporting means has a stepped portion having a horizontal portion for supporting the outer periphery of said image bearing member, and a vertical portion of the step is effective to limit longitudinal movement of said image bearing member.

12. A process cartridge detachably mountable to an image forming apparatus, comprising:
- an image bearing drum;
- process means actable on said image bearing drum, said process means including a developing roller for carrying a developer to supply the developer to said image bearing drum;
- a housing for accommodating said image bearing drum and said process means; and
- supporting means mounted on said housing for rotatably supporting an outer periphery of said image bearing drum and for rotatably supporting an outer periphery of said developing roller.

13. A cartridge according to claim 12, further comprising a portion functioning as a spacer for maintaining a predetermined clearance between said image bearing drum and said developing roller.

14. A cartridge according to claim 12, wherein said process means further comprises charging means and cleaning means.

15. A process cartridge detachably mountable to an image forming apparatus, comprising:
- an image bearing drum;
- at least one process means actable on said image bearing drum;
- a housing for accommodating said image bearing drum and said process means;
- supporting means fixedly mounted on said housing for rotatably supporting an outer periphery of said image bearing drum, wherein said supporting means further supports said process means.

16. A cartridge according to claim 15, wherein said supporting means supports cleaning means.

17. A cartridge according to claim 15, wherein said supporting means supports charging means.

18. An image forming apparatus for forming an image on a recording material, comprising:
- a process cartridge detachably mountable to an image forming apparatus, comprising
  - an image bearing member;
  - process means actable on said image bearing member;
  - a frame for supporting said process means;
  - supporting means mounted on said frame for rotatably supporting an outer periphery of said image bearing member; and
- mounting means for detachably receiving a process cartridge.

19. An apparatus according to claim 18, wherein said frame functions as said supporting means.

20. An apparatus according to claim 18, wherein said process means comprises charging means, developing means and cleaning means.

21. An apparatus according to claim 18, wherein said frame further comprises a second supporting means for rotatably supporting the outer periphery of said process means.

22. An apparatus according to claim 21, wherein said frame functions as said second supporting means.

23. An apparatus according to claim 18, wherein said supporting means supports a non-image forming portion of said image bearing member.

24. An apparatus according to claim 18, wherein said supporting means supports said image bearing member at its longitudinal end portions.

* * * * *

UNITED STATES PATENT AND TRADEMARK OFFICE

CERTIFICATE OF CORRECTION

PATENT NO. : 5,151,734

DATED : September 29, 1992

INVENTOR(S) : Tadayuki TSUDA, et al

It is certified that error appears in the above-indentified patent and that said Letters Patent is hereby corrected as shown below:

On the title page, item [56] References Cited, under U.S. PATENT DOCUMENTS: "Onodo et al." should read --Onoda et al.--.

Col. 1, line 23, "contain" should read --contains--.

Col. 2, line 31, "process," should read --process-.

Col. 3, line 62, "are" should read --is--.

Col. 5, line 19, "does" should read --do--.

Col. 5, line 20, "includes" should read --comprises--.

Signed and Sealed this

Twenty-second Day of February, 1994

*Attest:*

Bruce Lehman

BRUCE LEHMAN

*Attesting Officer*

*Commissioner of Patents and Trademarks*